US007145295B1

(12) United States Patent
Lee et al.

(10) Patent No.: US 7,145,295 B1
(45) Date of Patent: Dec. 5, 2006

(54) DIMMING CONTROL CIRCUIT FOR LIGHT-EMITTING DIODES

(75) Inventors: Rong-Chin Lee, Pingtung County (TW); Li-Cheng Chen, Kaohsiung (TW)

(73) Assignee: Aimtron Technology Corp., Hsinchu (TW)

( * ) Notice: Subject to any disclaimer, the term of this patent is extended or adjusted under 35 U.S.C. 154(b) by 8 days.

(21) Appl. No.: 11/161,128

(22) Filed: Jul. 24, 2005

(51) Int. Cl.
*G05F 1/00* (2006.01)

(52) U.S. Cl. ..... 315/291; 315/308; 315/360; 315/224; 315/169.3; 315/DIG. 4

(58) Field of Classification Search ..... 315/291, 315/307, 308, 312, 294, 360, 362, 193, 169.3, 315/DIG. 4; 363/89, 90, 126; 362/800
See application file for complete search history.

(56) References Cited

U.S. PATENT DOCUMENTS 6,362,578 B1 * 3/2002 Swanson et al. ..... 315/307
6,577,072 B1 * 6/2003 Saito et al. ..... 315/185 R
2006/0175986 A1 * 8/2006 Lee et al. ..... 315/312

OTHER PUBLICATIONS

"Built-in OVP white LED Step-Up Converter.", AIC 1648, Jul. 2004, pp. 1-10, Analog Integrations Corporation, Hsinchu, TW.
"White LED Step-Up Converter in Tiny Package.", RT9271, Apr. 2004, pp. 1-12, Richteck Technology Corp., Taipei, TW.
"1.2A PWN Boost Regulator Photo Flash LED Driver.", MIC2291, Aug. 2004, pp. 1-9, Micrel Inc., San Jose, CA, USA.
"Constant Current LED Driver.", TPS61042, Jan. 2003, pp. 1-22, Texas Instruments Incorporated, Dallas, Texas, USA.

* cited by examiner

*Primary Examiner*—Haissa Philogene
(74) *Attorney, Agent, or Firm*—Winston Hsu

(57) ABSTRACT

A dimming control circuit generates a dimming control signal for determining brightness of at least one light-emitting diode. The dimming control signal has a plurality of bright-dark cycles, each of which consists of a bright phase and a dark phase. The bright phase starts with an adaptive rising portion. The adaptive rising portion restricts the brightness of the at least one light-emitting diode to increase gradually from zero.

10 Claims, 8 Drawing Sheets

DIMMING CONTROL CIRCUIT FOR LIGHT-EMITTING DIODES

BACKGROUND OF THE INVENTION

1. Field of the Invention

The present invention relates to a dimming control circuit and, more particularly, to a dimming control circuit applied to a drive circuit for driving light-emitting diodes.

2. Description of the Prior Art

FIG. 1 is a circuit diagram showing a conventional light-emitting diode drive circuit 10. In the example of FIG. 1, the light-emitting diode drive circuit 10 is implemented by a boost-type switching voltage regulator for converting an input voltage $V_{in}$ into an output voltage $V_{out}$ desired for driving one or more series-connected light-emitting diodes LED. In accordance with a current $I_L$ flowing through an inductor L and a feedback voltage $V_{fb}$ from a resistor R, a switching control circuit 11 generates a fixed-duty pulse drive signal FS for turning on/off a switching transistor Q. The duty ratio of the switching transistor Q determines the proportional relationship between the output voltage $V_{out}$ and the input voltage $V_{in}$. The brightness of the light-emitting diodes LED varies depending on the diode current $I_{LED}$ flowing through themselves. From FIG. 1 is derived an equation regarding to the diode current $I_{LED}$: $I_{LED}=V_{fb}/R=(V_{out}-N*V_d)/R$, where N is the number of the light-emitting diodes and $V_d$ is a voltage drop of one single conductive light-emitting diode. Since the voltage drop $V_d$ may be considered approximately constant, the diode current $I_{LED}$ as well as the brightness of the light-emitting diodes LED is easily controlled by the adjustment to the output voltage $V_{out}$.

Another method of controlling the brightness of the light-emitting diodes LED appeals to the nature of human-eye perceptions. For bright-dark cycles alternating over about 60 Hz, the human eyes perceive an average brightness instead of flickering. In the bright phase the switching transistor Q is, as conventional, turned on/off by the fixed-duty pulse drive signal FS from the switching control circuit 11, but in the dark phase the fixed-duty pulse drive signal FS is blocked in order to keep the switching transistor Q nonconductive. In other words, through controlling the ratio of the bright phase to the dark phase, the desired average brightness is achieved. However, such a dimming method by using bright-dark cycles causes a huge current noise peak at the beginning of each bright phase. Because the frequency of the bright-dark cycles may be set within the audio-frequency range, the serially-occurred current noise peaks actually produce noisy sounds to human ears.

SUMMARY OF THE INVENTION

In view of the above-mentioned problems, an object of the present invention is to provide a dimming control circuit for light-emitting diodes, capable of reducing current noise peaks at the beginning of each bright cycle.

According to a first aspect of the present invention, a dimming control circuit generates a dimming control signal to determine a brightness of at least one light-emitting diode. The dimming control signal has a plurality of bright-dark cycles, each of which consists of a bright phase and a dark phase. The bright phase starts with an adaptive rising portion for restricting the brightness of the at least one light-emitting diode to increase gradually.

According to a second aspect of the present invention, a light-emitting diode drive circuit includes a switching control circuit, a switching voltage regulator, and a dimming control circuit. The switching control circuit generates a pulse drive signal. The switching voltage regulator is controlled by the pulse drive signal for driving at least one light-emitting diode. The dimming control circuit generates a dimming control signal to restrict a switching duty ratio of the pulse drive signal through the switching control circuit. The dimming control signal has a plurality of bright-dark cycles, each of which consists of a bright phase and a dark phase. The bright phase starts with an adaptive rising portion for restricting the switching duty ratio of the pulse drive signal to increase gradually.

According to a third aspect of the present invention, a light-emitting diode drive chip includes a pin, a control circuit, and an enabling circuit. The pin receives a brightness/shutdown signal. The control circuit generates a dimming signal in response to the brightness/shutdown signal so as to control a brightness of at least one light-emitting diode. The dimming signal has a plurality of bright-dark cycles, each of which consists of a bright phase and a dark phase. The bright phase starts with an adaptive rising portion for restricting the brightness of the at least one light-emitting diode to increase gradually. The enabling circuit generates an enable signal in response to the brightness/shutdown signal such that the enable signal activates the control circuit in the bright phase and terminates the control circuit when the dark phase exceeds a predetermined threshold time.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The above-mentioned and other objects, features, and advantages of the present invention will become apparent with reference to the following descriptions and accompanying drawings, wherein.

DETAILED DESCRIPTION

The preferred embodiments according to the present invention will be described in detail with reference to the drawings.

Figure 2:
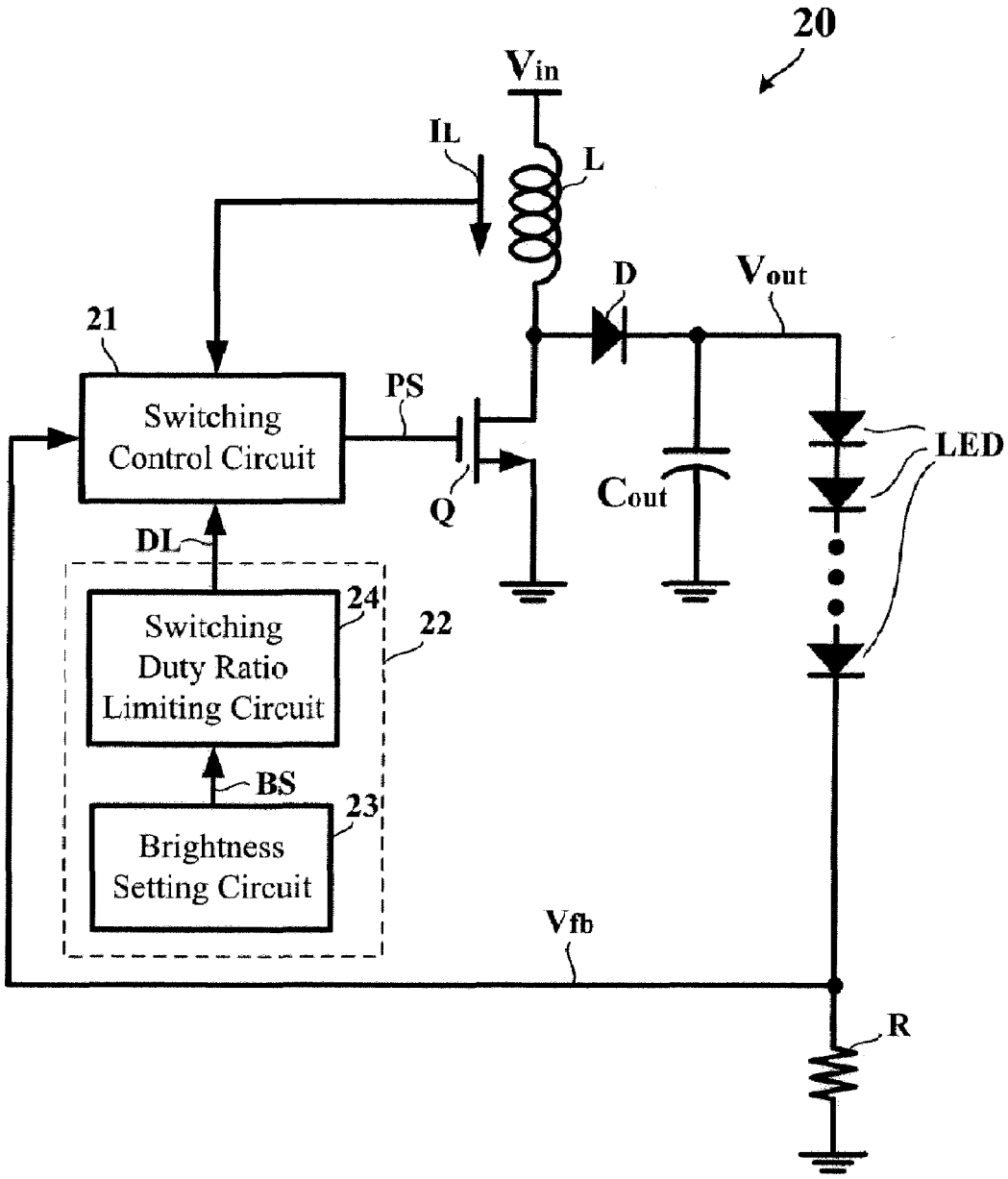
FIG. 2 is a circuit diagram showing a light-emitting diode drive circuit according to a first embodiment of the present invention.

FIG. 2 is a circuit diagram showing a light-emitting diode drive circuit 20 according to a first embodiment of the present invention. The light-emitting diode drive circuit 20 is provided with a switching control circuit 21 and a dimming control circuit 22, for driving a switching transistor Q and effectively controlling brightness of one or more series-connected light-emitting diodes LED. The dimming control circuit 22 applies a dimming control signal DL to the switching control circuit 21. Therefore, in addition to, the switching control circuit 21 generates a pulse drive signal PS whose switching duty ratio is determined in response not only to the conventional inductor current $I_L$ and feedback voltage $V_{fb}$ but also to the dimming control signal DL. More specifically, the dimming control circuit 22 has a brightness setting circuit 23 and a switching duty ratio limiting circuit 24. The brightness setting circuit 23 generates a brightness setting signal BS for determining an average brightness of the light-emitting diodes LED. In order to prevent the current noise peak at the beginning when the switching transistor Q is turned on from being so large as to cause noisy sounds, it is necessary for the brightness setting signal BS to be modulated through the switching duty ratio limiting circuit 24 into the dimming control signal DL, which is actually applied to the switching control circuit 21. In response to the dimming control signal DL, the switching control circuit 21 generates the pulse drive signal PS to be applied to the switching transistor Q.

Figure 3A:
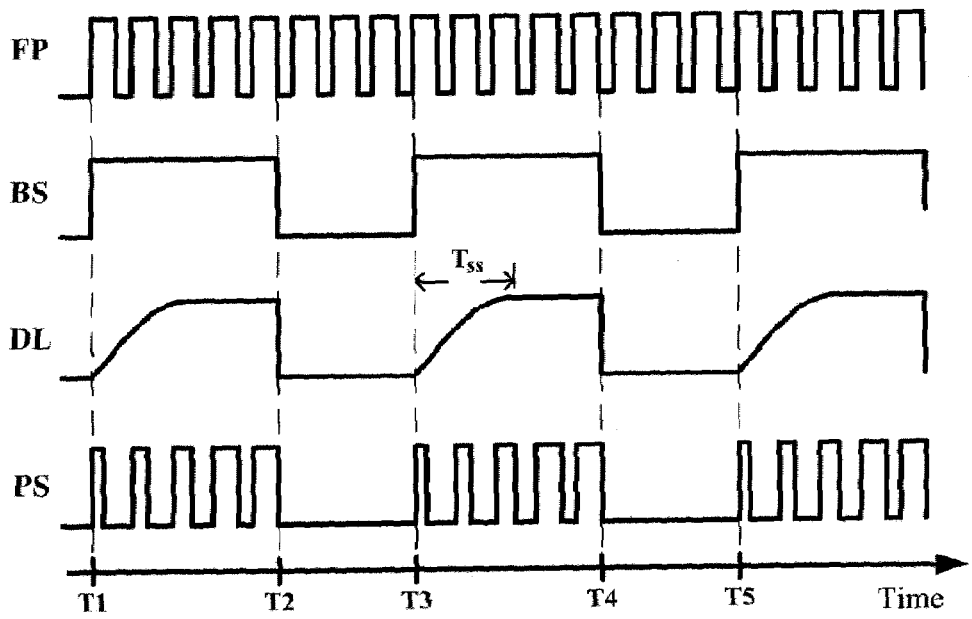
FIGS. 3(A) and 3(B) are timing charts showing operations of a light-emitting diode drive circuit according to a first embodiment of the present invention.
Figure 3B:
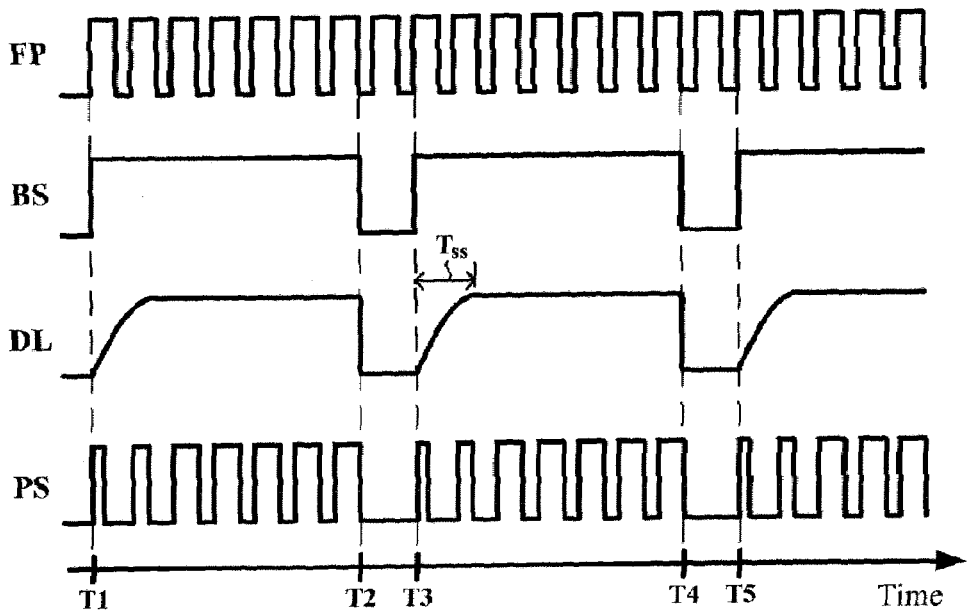

FIGS. 3(A) and 3(B) are timing charts showing operations of a light-emitting diode drive circuit 20 according to a first embodiment of the present invention. A brightness setting signal BS with a longer dark phase is illustrated in FIG. 3(A), which is applied to produce a darker average brightness of the light-emitting diodes LED. Another brightness setting signal BS with a shorter dark phase is illustrated in FIG. 3(B), which is applied to produce a brighter average brightness of the light-emitting diodes LED.

As shown in FIG. 3(A), the brightness setting signal BS is a pulse signal, alternating between a high level state and a low level state. The high level state is applied to allow the switching control circuit 21 to output a pulse signal PS having a switching duty ratio larger than zero. In this case, the input voltage $V_{in}$ can be consistently converted into the output voltage $V_{out}$ for supplying energy to drive the light-emitting diodes LED. Therefore, such a high level state represents a bright phase of a bright-dark cycle. In contrast, the low level state is applied to suppress the switching duty ratio of the pulse drive signal PS to become zero. In this case, the input voltage $V_{in}$ Stops supplying energy and then the brightness of the light-emitting diodes LED becomes dark. Therefore, such a low level state represents a dark phase of a bright-dark cycle. The bright-dark cycles provided by the brightness setting signal BS are applied to produce an average brightness of the light-emitting diodes LED when perceived by the human eyes. Through adjusting the ratio of the bright phase to the dark phase, the average brightness of the light-emitting diodes LED is effectively determined by the brightness setting signal BS.

In order to reduce the current noise peaks, the bright phase of the brightness setting signal BS should have to be modified through the switching duty ratio limiting circuit 24 so as to make the dimming control signal DL get started with an adaptive rising portion in the bright phase each cycle. The time taken by the adaptive rising portion, referred to as a soft-start time $T_{ss}$ later, is determined in accordance with the time taken by a dark phase of a previous bright-dark cycle. This is the reason why the rising portion is called adaptive in this specification. When the dark phase of the previous bright-dark cycle is longer in time, the soft-start time $T_{ss}$ of the bright phase immediately after the longer dark phase is made longer. This is because the longer dark phase results in a greater degree of reduction in the output voltage $V_{out}$, in some case even down to the ground potential, a longer soft-start time $T_{ss}$ provides a longer transition of the switching duty ratio from zero to a maximum and therefore helps reduce the current noise peak at the beginning of the bright phase. In comparison of FIGS. 3(A) and 3(B), easily realized is that the dimming control signal DL in FIG. 3(A) has a longer soft-start time $T_{ss}$ since the dark phase of the previous bright-dark cycle is longer, for example, from the time T2 to T3.

Figure 1:
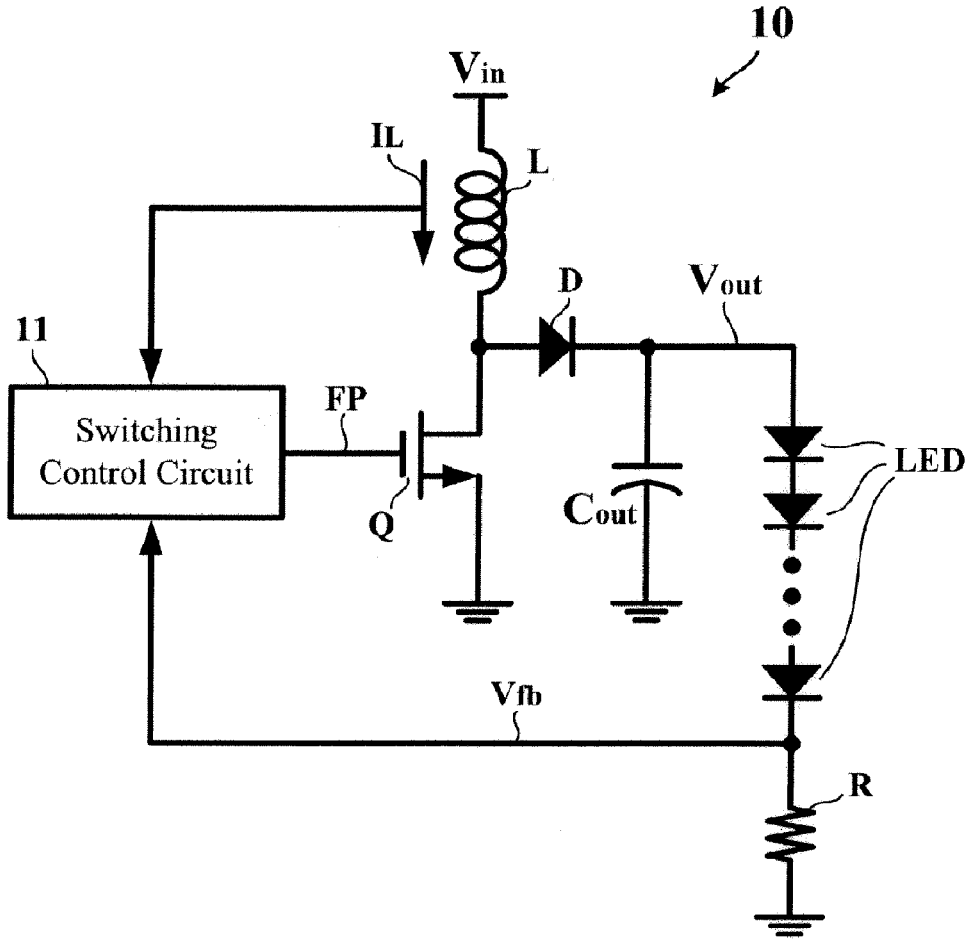
FIG. 1 (Prior Art)
FIG. 1 is a circuit diagram showing a conventional light-emitting diode drive circuit.

For appropriately illustrating the restriction provided by the dimming control signal DL to the switching duty ratio of the pulse drive signal PS, FIGS. 3(A) and 3(B) additionally shows a conventional pulse drive signal FS with a fixed duty ratio generated from the circuit 11 of FIG. 1. Through the restriction provided by the dimming control signal DL, the pulse drive signal PS has a first portion, corresponding to the bright phase, having a duty ratio gradually increasing from zero to a maximum during the adaptive soft-start time $T_{ss}$ and a second portion, corresponding to the dark phase, having a zero duty ratio suppressed to zero. It should be noted that the frequency of the pulse drive signal PS is in practice much higher than that of the dimming control signal DL. For example, the frequency of the pulse drive signal PS is about 1.2 MHz while the frequency of the dimming control signal DL is only about 1 KHz. For the sake of simplicity, only are some exemplary pulses shown in FIGS. 3(A) and 3(B), especially for the first portion corresponding to the bright phase of the dimming control signal DL.

Figure 4:
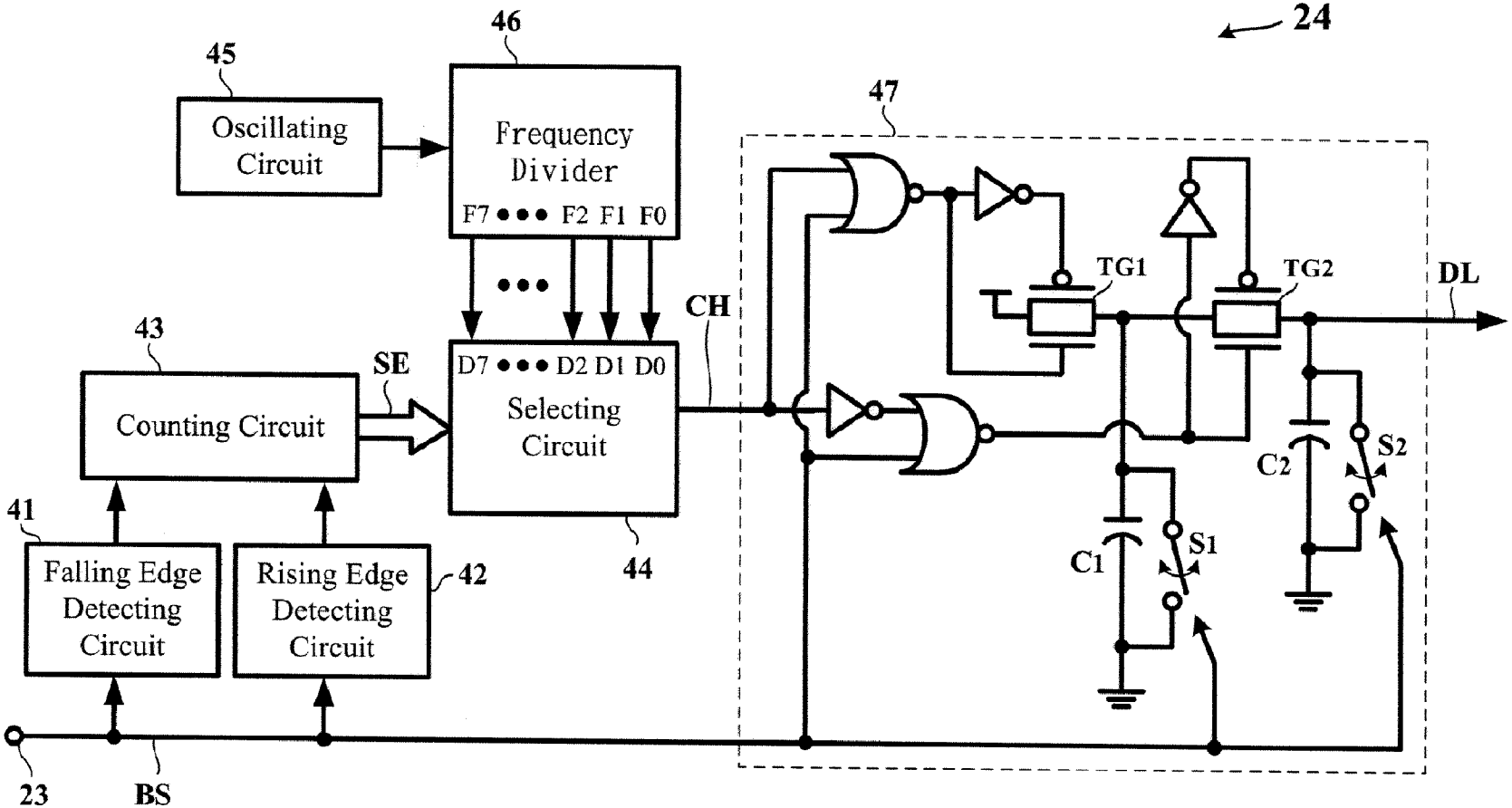
FIG. 4 is a circuit diagram showing a switching duty ratio limiting circuit according to a first embodiment of the present invention.

FIG. 4 is a circuit diagram showing a switching duty ratio limiting circuit 24 according to a first embodiment of the present invention. A falling edge detecting circuit 41 is triggered by a falling edge of the brightness setting signal BS while a rising edge detecting circuit 42 is triggered by a rising edge of the brightness setting signal BS. Starting to count upon the occurrence of the falling edge and stopping counting upon the occurrence of the rising edge, a counting circuit 43 generates a digital selection signal SE for indicating the time taken by the dark phase of the brightness setting signal BS. In response to the digital selection signal SE, a selecting circuit 44 outputs a charge signal CH whose frequency is selected from eight different frequencies F0 to F8. When the counting circuit 43 indicates a longer dark phase of the brightness signal BS, the selecting circuit 44 outputs a charge signal CH with a lower frequency. When the counting circuit 43 indicates a shorter dark phase of the brightness setting signal BS, the selecting circuit 44 outputs a charge signal CH with a higher frequency. After frequency-dividing an oscillating signal from an oscillating circuit 45, a frequency divider 46 generates these eight-different-frequency charge signals CH. It should be noted that the selecting circuit 44 and the frequency divider 46 according to the present invention are not limited to generating eight different frequencies, but may be applied to generate more or less than eight different frequencies. The charge signal CH is applied to a charging circuit 47 to control transmission gates TG1 and TG2 for charging capacitors C1 and C2. When the charge signal CH has a lower frequency, the capacitors C1 and C2 are charged at a slower rate. As a result, the adaptive rising portion of the dimming control signal DL is provided with a longer soft-start time $T_{ss}$, as shown in FIG. 3(A). When the charge signal CH has a higher frequency, the capacitors C1 and C2 are charged at a faster rate. As a result, the adaptive rising portion of the dimming control signal DL is provided with a shorter soft-start time $T_{ss}$, as shown in FIG. 3(B).

When the brightness setting signal BS from the brightness setting circuit 23 is at the low level state, two switching units S1 and S2 are both short-circuited. As a result, the dimming control signal DL output from the charging circuit 47 is kept at the ground potential. Once the brightness setting signal BS transitions to the high level, the switching units S1 and S2 are open-circuited such that the charging circuit 47 is allowed to perform the charging operation at the frequency determined by the charge signal CH from the selecting circuit 44. Consequently, the dimming control signal DL gradually increases from the ground potential to the maximum during the soft-start time $T_{ss}$ determined in accordance with the time taken by the dark phase of the previous bright-dark cycle.

Figure 5:
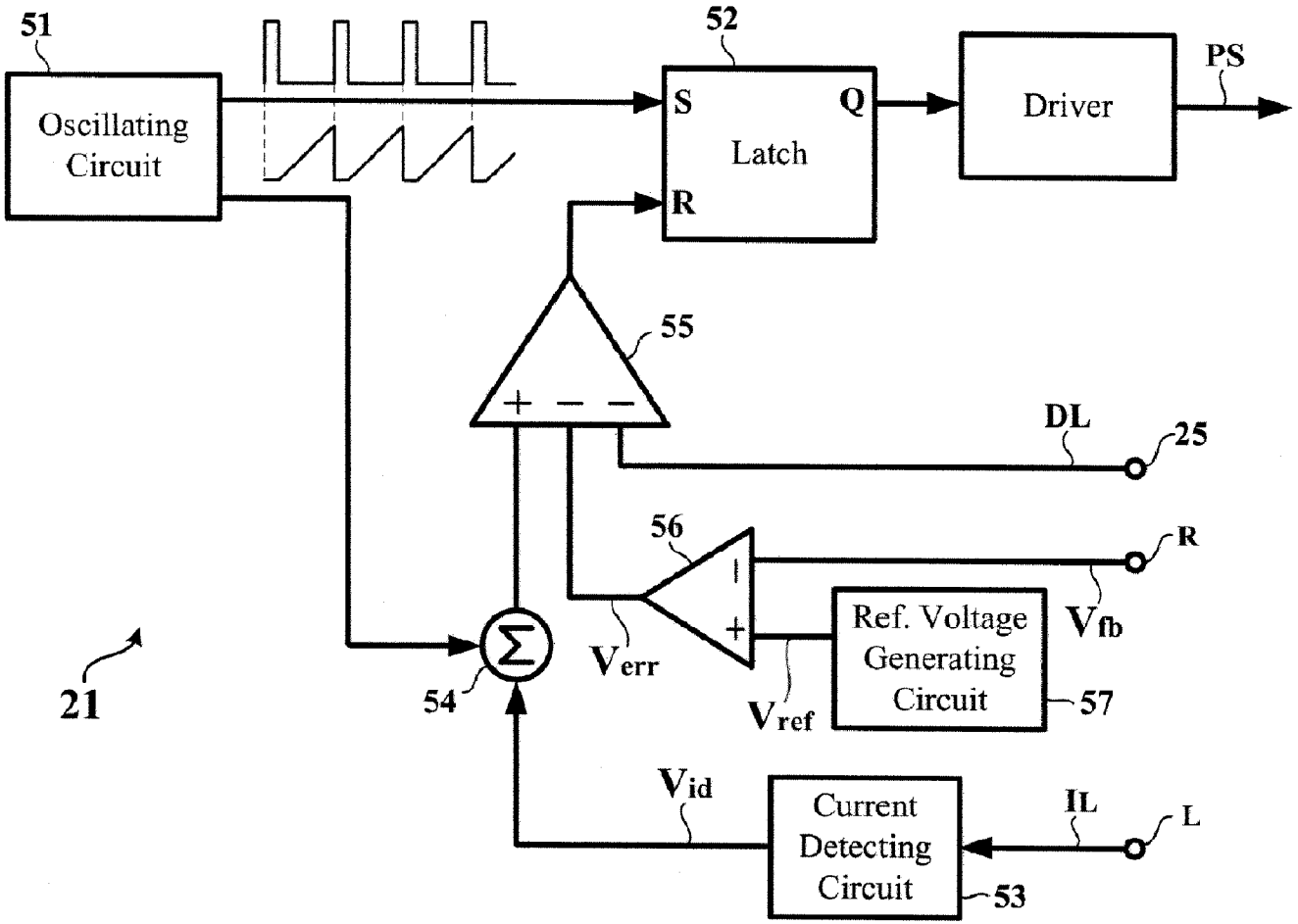
FIG. 5 is a circuit diagram showing a switching control circuit according to a first embodiment of the present invention.

FIG. 5 is a circuit diagram showing a switching control circuit 21 according to a first embodiment of the present invention. An oscillating circuit 51 applies a pulse signal to a set input terminal S of a latch 52 for triggering the pulse drive signal PS into the high level state so as to turn on the switching transistor Q of FIG. 2. Once the switching transistor Q is turned on, the inductor current $I_L$ flowing through the inductor L starts to increase. A current detecting circuit 53 generates a current detection signal $V_{id}$ representative of the inductor current $I_L$. After the slope-compensation carried out through an adding circuit 54, the current detection signal $V_{id}$ is applied to a non-inverting input terminal of a comparing circuit 55. Furthermore, the comparing circuit 55 has two inverting input terminals for receiving an error signal $V_{err}$ and the dimming control signal DL, respectively. The error signal $V_{err}$ is generated from an error amplifying circuit 56 for indicating a difference between the feedback voltage $V_{fb}$ from the resistor R of FIG. 2 and a reference voltage $V_{ref}$ from a reference voltage generating circuit 57. Once the slope-compensated current detection signal $V_{id}$ exceeds the smaller of the error signal $V_{err}$ and the dimming control signal DL, the comparing circuit 55 triggers a reset input terminal R of the latch 52. Therefore, the dimming control signal DL effectively limits the switching duty ratio of the pulse drive signal PS.

Figure 6:
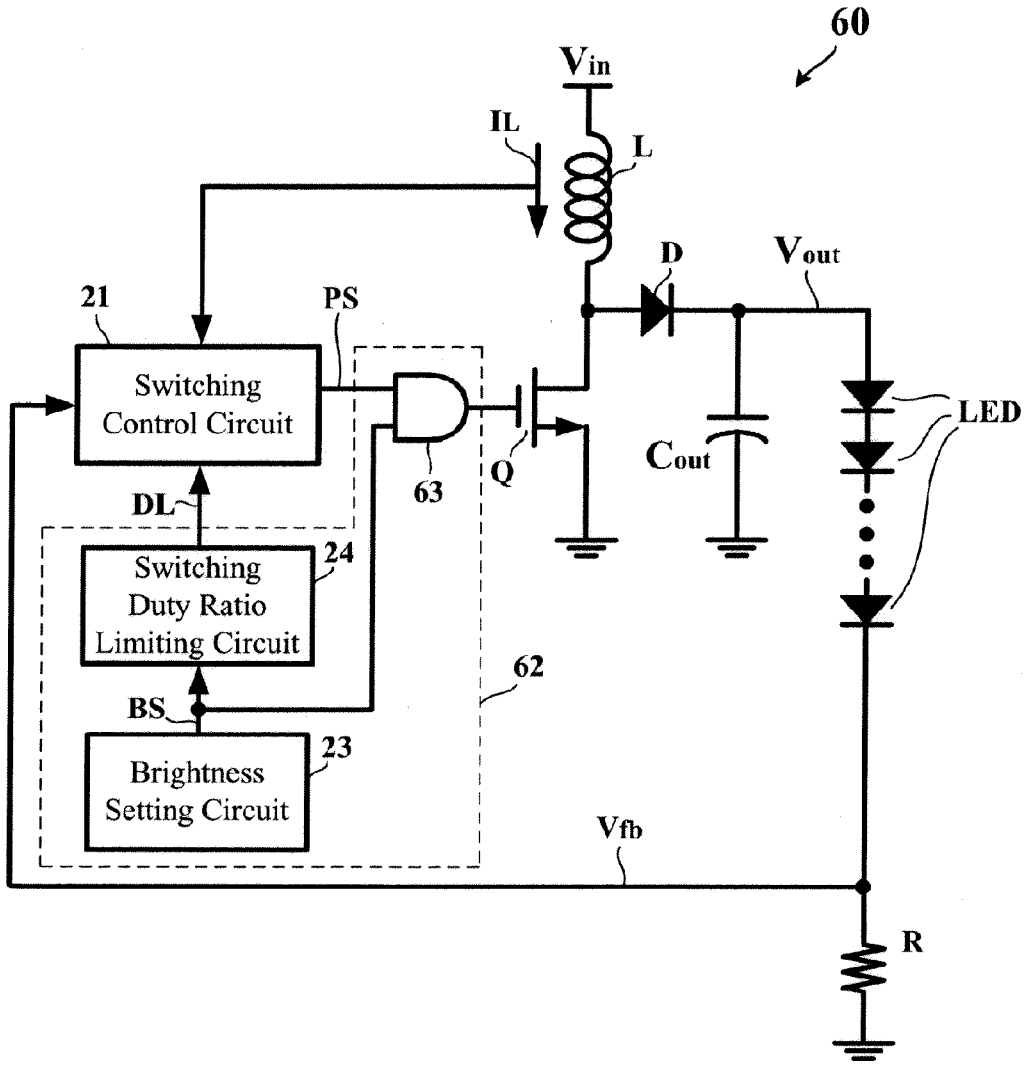
FIG. 6 is a circuit diagram showing a light-emitting diode drive circuit according to a second embodiment of the present invention.

FIG. 6 is a circuit diagram showing a light-emitting diode drive circuit 60 according to a second embodiment of the present invention. The second embodiment is different from the first embodiment in that a dimming control circuit 62 according to the second embodiment further includes a logic unit 63. As shown, the logic unit 63 makes possible the brightness setting signal BS to directly turn off the switching transistor Q. More specifically, once the brightness setting signal BS transitions to the low level, the switching transistor Q is immediately turned off without waiting for the response from the pulse drive signal PS. On the other hand, when the brightness setting signal BS is at the high level state, the logic unit 63 simply allows the pulse drive signal PS to pass through and to control the switching transistor Q as the first embodiment does.

Figure 7:
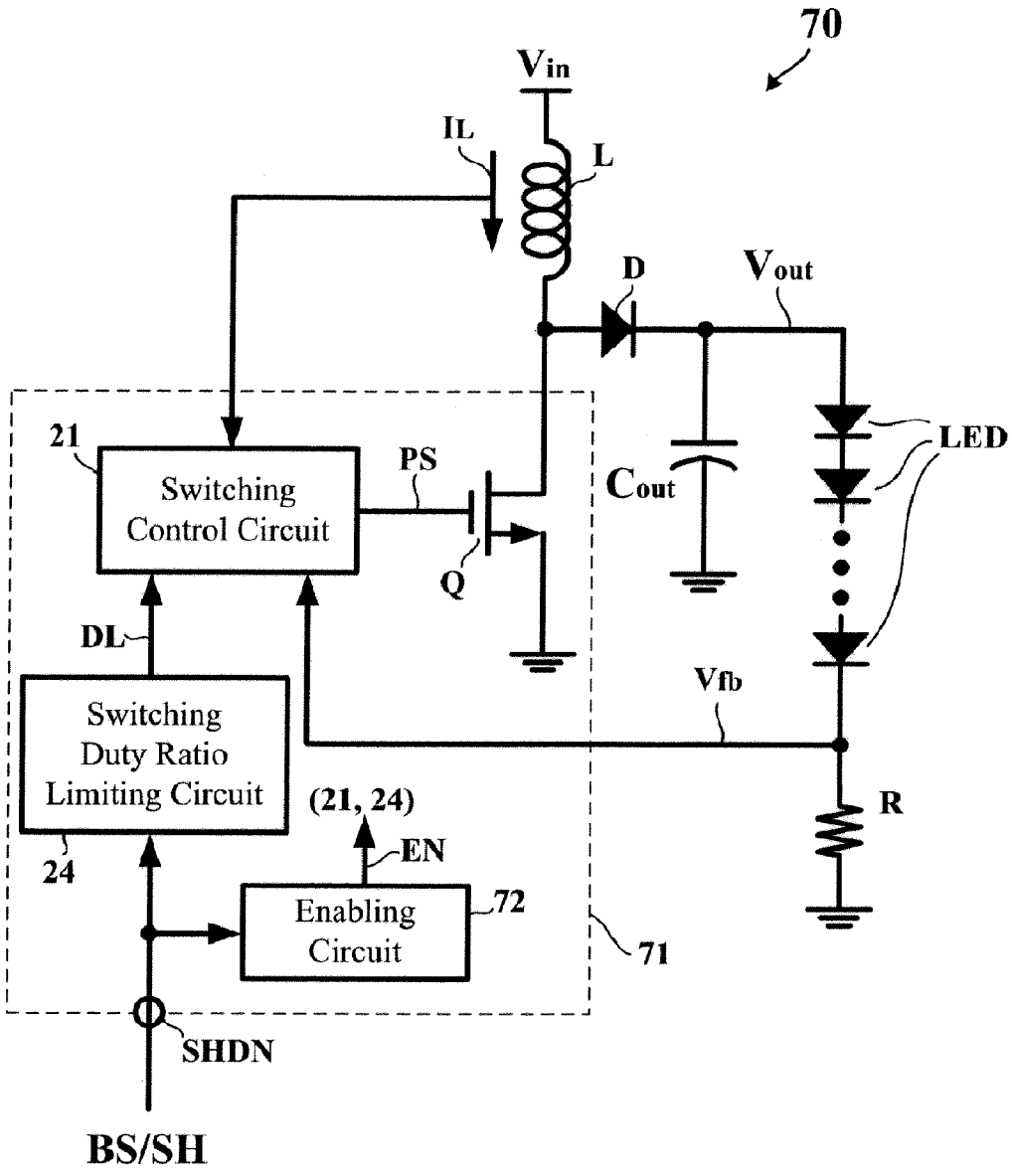
FIG. 7 is a circuit diagram showing a light-emitting diode drive circuit according to a third embodiment of the present invention.

FIG. 7 is a circuit diagram showing a light-emitting diode drive circuit 70 according to a third embodiment of the present invention. Referring to FIG. 7, in today's integrated circuits manufacturing, the switching control circuit 21, the switching duty ratio limiting circuit 24, and the switching transistor Q are usually incorporated into a single chip 71 with several electrical pins provided around the circumference of the chip's package for connecting external circuits. In order to save the number of the pins, the light-emitting diode drive control chip 71 utilizes a shutdown pin SHDN to receive a two-fold brightness/shutdown signal BS/SH. More specifically, the brightness/shutdown signal BS/SH can, on one hand, set the brightness of the light-emitting diodes LED like a brightness setting signal and, on the other hand, disconnect the power from all components of the whole chip 71 like a shutdown signal. Through such a common pin SHDN, the brightness/shutdown signal BS/SH is applied to the switching duty ratio limiting circuit 24 and an enabling circuit 72. The enabling circuit 72 generates an enable signal EN for activating or terminating the switching control circuit 21 and the switching duty ratio limiting circuit 24.

Figure 8:
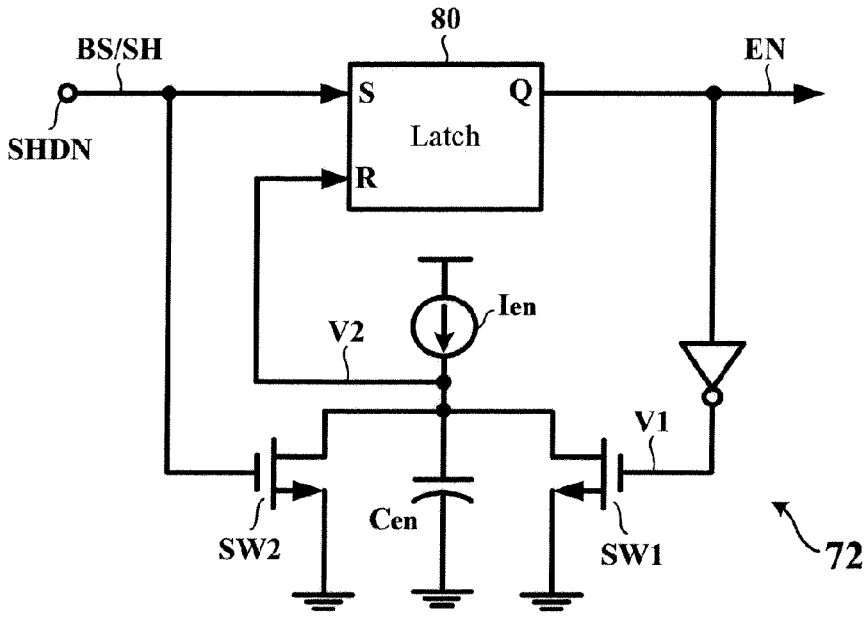
FIG. 8 is a circuit diagram showing an enabling circuit according to the present invention.
Figure 9:
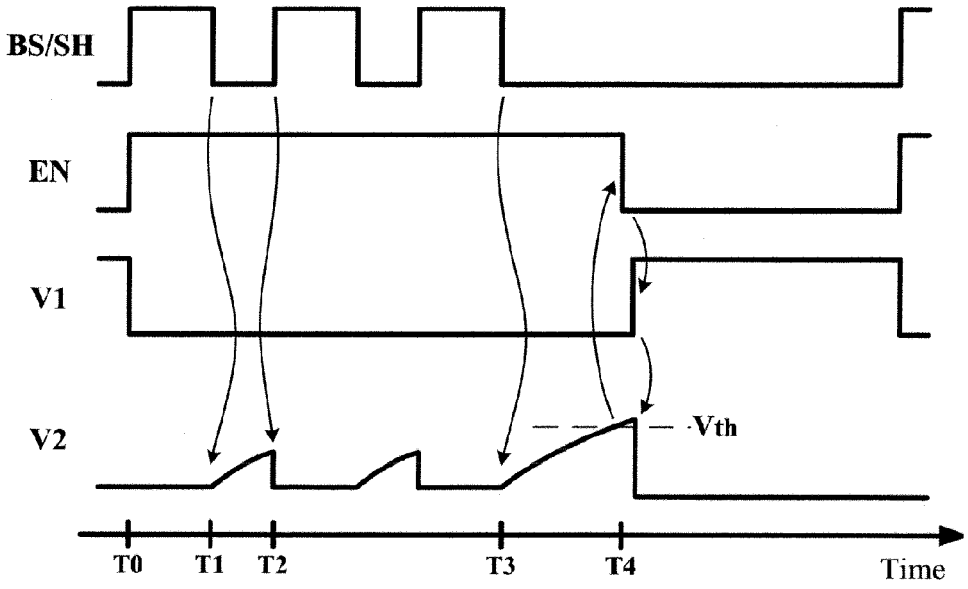
FIG. 9 is a timing chart showing an operation of an enabling circuit according to the present invention.

FIG. 8 is a circuit diagram showing an enabling circuit 72 according to the present invention. FIG. 9 is a timing chart showing an operation of an enabling circuit 72 according to the present invention. When the brightness/shutdown signal BS/SH transitions to the high level, as shown at the time T0 of FIG. 9, a latch 80 is triggered to generate a high level in the enabling signal EN for activating the light-emitting diode drive control chip 71. In addition, the transistor SW1 is turned off and the transistor SW2 is turned on such that a potential difference V2 across a capacitor $C_{en}$ falls to zero. When the brightness/shutdown signal BS/SH transitions to the low level, as shown at the time T1 of FIG. 9, the transistor SW2 is turned off to allow a current source $I_{en}$ to charge the capacitor $C_{en}$, resulting in a gradual increase of the potential difference V2. If the brightness/shutdown signal BS/SH transitions back to the high level in a short time, as shown at the time T2 of FIG. 9, the potential difference might not be large enough to trigger a reset input terminal R of the latch 80. In this case, the enable signal EN stays at the high level state without any change and therefore the brightness/shutdown signal BS/SH is functioning as a brightness setting signal. If the brightness/shutdown signal BS/SH stays at the low level long enough for allowing the potential difference V2 to exceed a threshold voltage $V_{th}$ so as to trigger the reset input terminal R, as shown at the time T4 of FIG. 9, the enable signal EN transitions to the low level and shutdowns the light-emitting diode drive control chip 71.

It should be noted that although the embodiments described above are related to the boost-type switching voltage regulator, the present invention is not limited to this and may be applied to other types of voltage regulators such as buck-type, synchronous switching type, and so on. Except for the current-mode pulse-width-modulation technique, the switching control circuit according to the present invention may use a voltage-mode pulse-width-modulation technique or a constant ON-time or OFF-time pulse-frequency-modulation technique, and so on.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. A light-emitting diode drive circuit comprising:

a switching control circuit for generating a pulse drive signal;

a switching voltage regulator controlled by the pulse drive signal for driving at least one light-emitting diode; and a dimming control circuit for generating a dimming control signal to restrict a switching duty ratio of the pulse drive signal through the switching control circuit, wherein:

the dimming control signal has a plurality of bright-dark cycles, each of which consists of a bright phase and a dark phase, the bright phase starting with an adaptive rising portion for restricting the switching duty ratio of the pulse drive signal to increase gradually.

2. The circuit according to claim 1, wherein:

the adaptive rising portion is determined in accordance with a dark phase of a previous bright-dark cycle.

3. The circuit according to claim 2, wherein:

the adaptive rising portion is longer when the dark phase of the previous bright-dark cycle is longer.

4. The circuit according to claim 1, further comprising:

a logic unit for preventing the pulse drive signal from being applied to the switching voltage regulator in the dark phase, and for allowing the pulse drive signal to be applied to the switching voltage regulator in the bright phase.

5. The circuit according to claim 1, further comprising:

an enabling circuit for activating the switching control circuit and the dimming control circuit in the bright phase, and for terminating the switching control circuit and the dimming control circuit when the dark phase exceeds a predetermined threshold time.

6. A light-emitting diode drive chip, comprising:

a pin for receiving a brightness/shutdown signal;

a control circuit for generating a dimming signal in response to the brightness/shutdown signal so as to control a brightness of at least one light-emitting diode, the dimming signal having a plurality of bright-dark cycles, each of which consists of a bright phase and a dark phase, the bright phase starting with an adaptive rising portion for restricting the brightness of the at least one light-emitting diode to increase gradually; and an enabling circuit for generating an enable signal in response to the brightness/shutdown signal such that the enable signal activates the control circuit in the bright phase and terminates the control circuit when the dark phase exceeds a predetermined threshold time.

7. The chip according to claim 6, wherein:

the adaptive rising portion is determined in accordance with a dark phase of a previous bright-dark cycle.

8. A dimming control circuit generating a dimming control signal to determine a brightness of at least one light-emitting diode, the dimming control signal having a plurality of bright-dark cycles, each of which consists of a bright phase and a dark phase, the bright phase starting with an adaptive rising portion for restricting the brightness of the at least one light-emitting diode to increase gradually.

9. The circuit according to claim 8, wherein:

the adaptive rising portion is determined in accordance with a dark phase of a previous bright-dark cycle.

10. The circuit according to claim 9, wherein:

the adaptive rising portion is longer when the dark phase of the previous bright-dark cycle is longer.

* * * * *